US005661510A

United States Patent [19]

Brandon et al.

[11] Patent Number: 5,661,510

[45] Date of Patent: Aug. 26, 1997

[54] INK-JET CARTRIDGE VENTING

[75] Inventors: Fred Young Brandon, Lexington, Ky.; Curtis Ray Droege, Centralia, Ill.

[73] Assignee: Lexmark International, Inc., Lexington, Ky.

[21] Appl. No.: 343,693

[22] Filed: Nov. 22, 1994

[51] Int. Cl.[6] ..... B41J 2/175; B41J 2/165

[52] U.S. Cl. ..... 347/87; 347/29

[58] Field of Search ..... 347/44, 47, 29, 347/30, 87, 84–86

[56] References Cited

U.S. PATENT DOCUMENTS

| | | | |
|---|---|---|---|
| 4,847,637 | 7/1989 | Watanabe et al. | 347/30 |
| 5,027,134 | 6/1991 | Harmon et al. . | |
| 5,146,243 | 9/1992 | English et al. . | |
| 5,155,497 | 10/1992 | Martin et al. . | |
| 5,216,449 | 6/1993 | English . | |

FOREIGN PATENT DOCUMENTS 0 580 437 A2 1/1994 European Pat. Off. .

*Primary Examiner*—Benjamin R. Fuller
*Assistant Examiner*—Judy Nguyen
*Attorney, Agent, or Firm*—B. Franklin Griffin, Jr.

[57] ABSTRACT

A cartridge for an ink-jet printer includes a nozzle plate having nozzles therein. A region around the nozzles is sealed when a maintenance cap is moved into contact with a surface of the cartridge surrounding the nozzle plate. Vent passages are provided in the cartridge body for venting the sealed region to the atmosphere. The vent passages are formed as grooves in a surface of the cartridge body, the open sides of the grooves being closed by an adhesive preform which attaches a tab circuit to the surface. One end of each passage vents to the atmosphere at a second surface of the cartridge body underneath a portion of the tab circuit which is not adhesively attached to the second surface. A second end of each vent passage extends into a region of the first surface that is not covered by the adhesive preform and tab circuit so that the vent passages communicate with the sealed region formed when the cap is moved into contact with the cartridge.

18 Claims, 4 Drawing Sheets

INK-JET CARTRIDGE VENTING

FIELD OF THE INVENTION

The present invention relates to cartridges for ink-jet printers and more particularly to cartridges having one or more air vent passages for relieving pressure in the region between the cartridge and a cap as the cartridge is capped or uncapped.

BACKGROUND OF THE INVENTION

It is conventional to provide a maintenance station for ink-jet printers, the maintenance station including a wiper for wiping the nozzle plate of the printhead cartridge and a cap for providing a sealed environment around the ink-jet nozzles to prevent ink from drying in the nozzles during periods of non-use.

The cap is a cup-shaped elastomeric member which is brought into contact with a nozzle plate/chip/tab circuit assembly on the cartridge to accomplish capping. As the cap is moved into contact with the cartridge, air may be trapped between the cap and the cartridge and forced through the nozzles and into adjacent ink feed channels through which ink is supplied to the nozzles. Ink is normally sucked through the feed channels by the firing of the nozzles hence the forcing of air into the feed channels can lead to a loss of prime and degraded performance of the cartridge.

A further problem may be encountered as the cartridge is uncapped. If the cup has formed an air-tight seal against the cartridge, then as the cup is moved away from the cartridge a vacuum may be created in the sealed region thus drawing ink out of the ink feed channels. This depletes the ink supply and thus shortens the useful life of the cartridge. Furthermore, the excess ink contaminates the region of the printer where the maintenance station is located.

Various means are known for relieving the pressure at the nozzles as the cartridge is capped or uncapped. U.S. Pat. No. 5,155,479 provides a cap with notches in the edges of the cap that contact the cartridge, the notches serving as passages through which air may flow from the sealed region to the surrounding environment. However, the maintenance station region is prone to contamination due to planned ink spitting, and air flow passages provided in or on the cap may become clogged or blocked. Furthermore, a given printer may use different cartridges some of which might require different controlled levels of venting.

SUMMARY OF THE INVENTION

An object of the present invention is to provide a cartridge for an ink-jet printer, the cartridge having at least one air vent passage through which air may flow as the cartridge is capped or uncapped.

Another object of the invention is to provide vent means for venting the region between a cartridge and a cap, the vent means being located on the cartridge and sized to match the venting requirements of the cartridge on which it is located.

A further object of the invention is to provide a vent means for venting the region between a cartridge and a cap, the vent means being less prone to blockage than vent means heretofore known.

Yet another object of the invention is to provide a cartridge for an ink-jet printer, the cartridge having a contact surface which may be intermittently contacted by a cap to form an air sealed region around nozzles in a nozzle plate, and vent passage means in the cartridge for connecting the region to ambient environment to thereby inhibit pressure changes at the nozzles as the contact surface is intermittently contacted.

Still another object of the invention is to provide a cartridge for an ink-jet printer, the cartridge comprising a cartridge body having a recess and a groove in a first surface, the groove extending from the recess to a second surface of the body; a nozzle plate disposed in the recess and tab circuit means attached to the first surface by an adhesive preform, the tab circuit means and the adhesive preform overlaying the groove to form an air vent passage, the tab circuit means and the adhesive preform having openings therein which are larger than the recess so that the first surface has an exposed region adjacent the recess, the groove extending into the exposed region whereby a portion of the groove is open to a surrounding environment.

Another object of the invention is to provide a cartridge as described above having a plurality of air vent passages. Preferably, the vent passages are of serpentine configuration to increase their length so that the degree of venting, or diffusion, can be tuned for a particular print cartridge design.

Other objects of the invention and the manner of making and using it will be obvious upon consideration of the following description and the accompanying drawings.

DESCRIPTION OF THE INVENTION

The invention will be described in the context of a tri-color ink-jet cartridge but it will be evident from the following description that the principles of the invention are equally applicable to monochrome cartridges.

Figure 1:
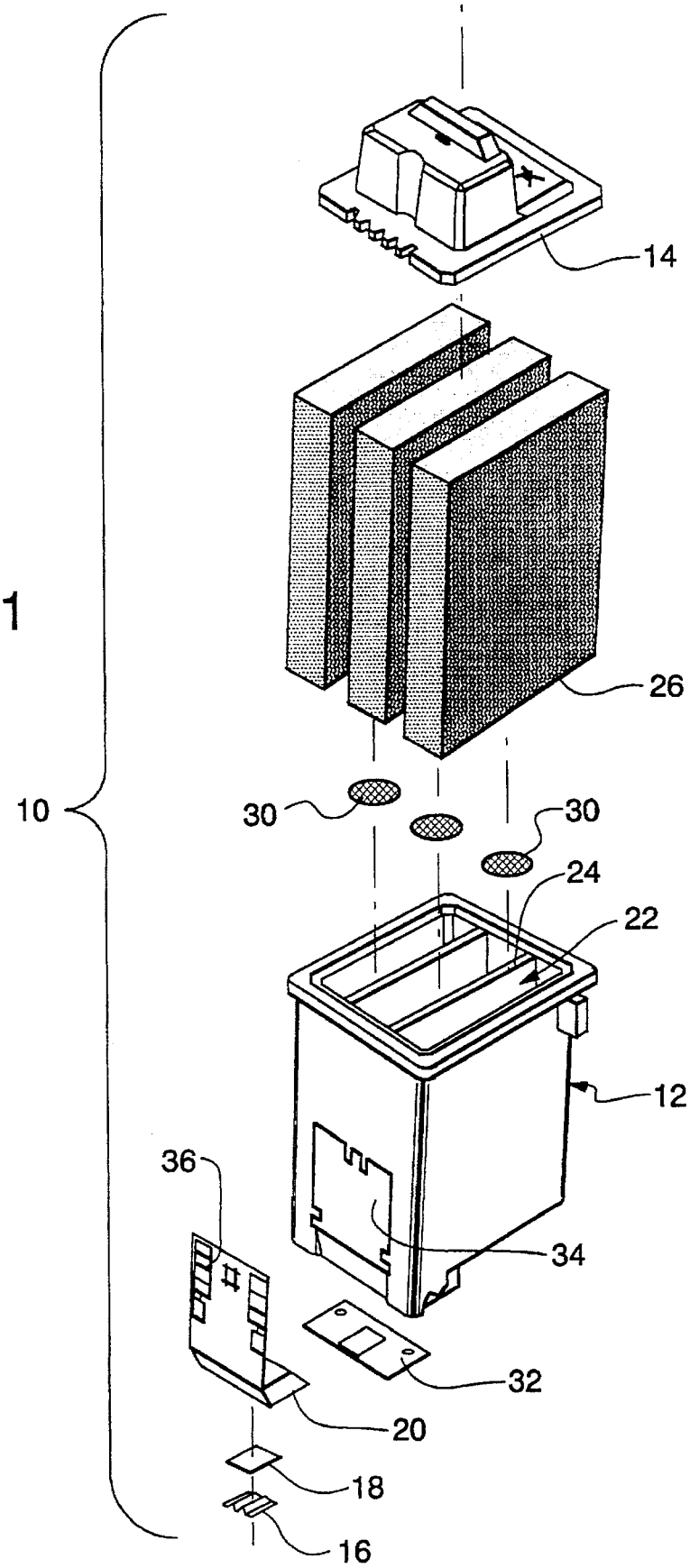
FIG. 1 is an exploded view of a tri-color ink-jet printer cartridge.

As shown in FIG. 1, a tri-color ink-jet printer cartridge 10 comprises a cartridge body 12, a lid 14, a nozzle plate 16, a heater chip 18 and a tab circuit means 20. The cartridge body 12 has a hollow interior divided into three ink reservoir chambers 22 by two dividing walls 24. Three blocks 26 of foam material are inserted into chambers 22, each block being saturated with ink of a different color.

As explained in Brandon et al. copending application Ser. No. 08/321,344, filed Oct. 11, 1994, assigned to the same assignee as the present application, the chambers 22 are provided with standpipes on their bottom surfaces through which ink may flow, the cartridge body 12 having ink flow passages connecting the standpipes to three exit ports in the bottom surface of the body. Three filters 30 cover the tops of the standpipes to filter the inks as they are drawn out of the chambers 22.

Figure 2:
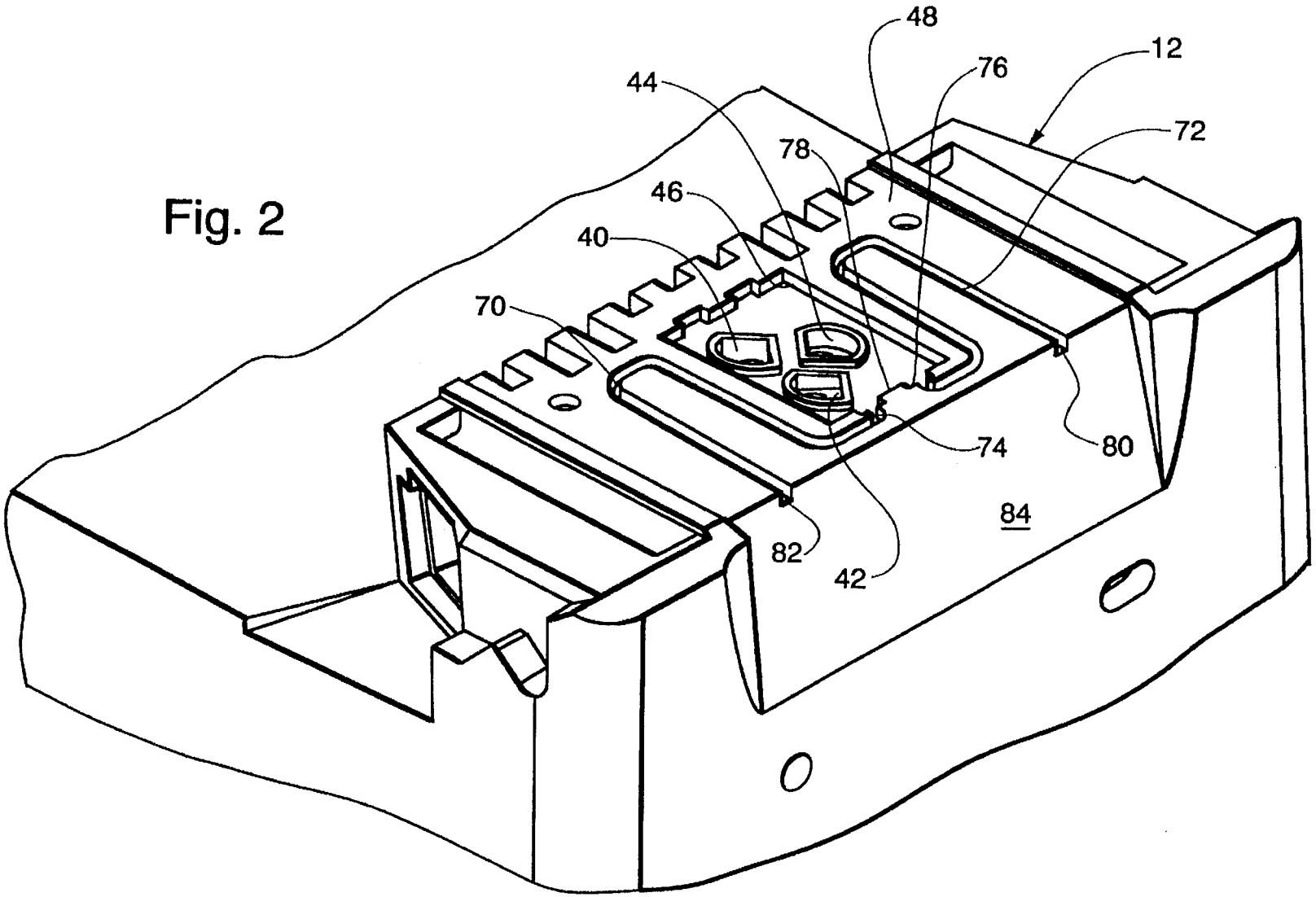
FIG. 2 is a perspective view of the bottom portion of the cartridge with the tab circuit, nozzle plate and heater removed to reveal air vent passages.
Figure 3:
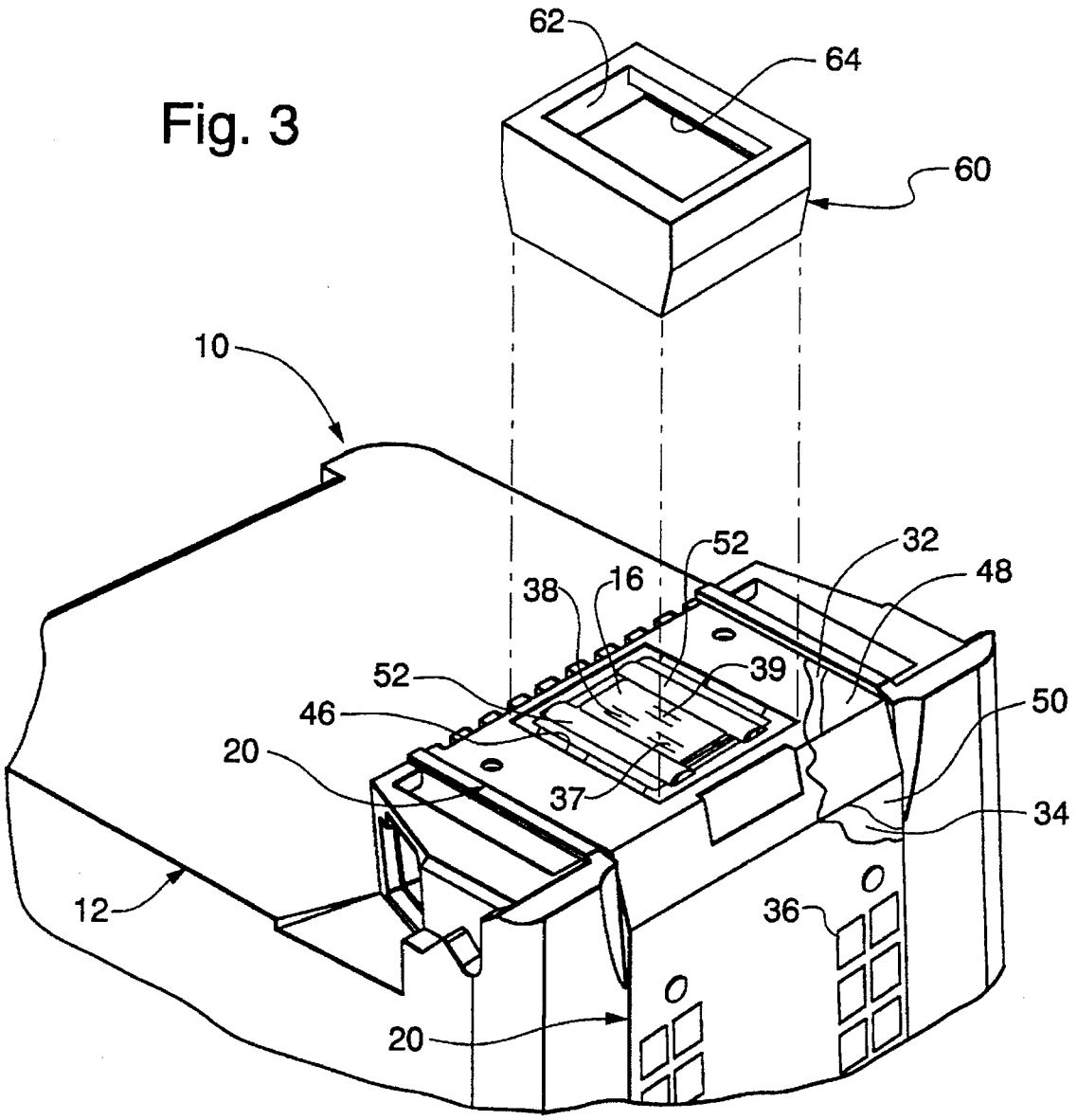
FIG. 3 is a perspective view of a maintenance cap and the bottom portion of the cartridge; and, FIG. 4 is a perspective view of the bottom portion of the cartridge with parts of the tab circuit and adhesive preform removed to reveal an air vent passage.

FIG. 2 shows three exit ports 40, 42 and 44 located in a recess 46 in a first or bottom surface 48 of cartridge body 12. The nozzle plate 16 and heater chip 18 are positioned in recess 46. As shown in FIG. 3, the nozzle plate 16 has three groups of nozzles 37, 38, 39 each group of nozzles being associated with, and receiving ink from, one of the exit ports 40, 42 and 44. The heater chip 18 is positioned between the exit ports and nozzle plate and is not visible in FIG. 3.

As shown in FIG. 3, the tab circuit means 20 is attached to a side surface 50 (hereafter referred to as a third surface) of cartridge body 12 by a first adhesive preform 34. The tab circuit is attached to the bottom surface 48 by a second adhesive preform 32. The tab circuit is provided with an opening 88 (FIG. 4) and the second adhesive preform 32 is provided with an opening 89. The openings 88 and 89 are aligned with each other and with the recess 46. The tab circuit 20 is a flexible tape-like element on which terminals 36 are located. Conductors (not shown) are embedded in the tab circuit for connecting the terminals 36 to the heater chip 18. Beads 52 of epoxy encapsulate the conductors where they extend from the tab circuit to the heater chip. For brevity, the tab circuit means 20 is hereafter referred to as the tab circuit.

Printing with cartridge 10 takes place in a conventional manner. As the cartridge is moved back and forth transverse to the direction of movement of a sheet of paper, electrical signals are applied from a source (not shown) to terminals 36 and, in accordance with these signals the heater chip 18 heats ink, causing the ink to be ejected from the cartridge through selected nozzles of nozzle groups 37, 38, 39 and the openings 88 and 89. As ink is ejected from a nozzle, a vacuum is created in the exit port associated with the nozzle. This vacuum is communicated through ink passages (not shown) in the cartridge body 12 to an ink reservoir chamber 22 to suck more ink from the ink reservoir chamber.

It is conventional as part of a maintenance routine to "cap" the cartridge 10 during periods of non-use to delay or prevent ink in the nozzles from drying. Capping is accomplished by moving a cup-like elastomeric cap into contact with the cartridge 10 so as to form a sealed region which encloses the nozzles 37, 38, 39. FIG. 3 shows a conventional cap 60 in a non-capping position, that is, moved away from cartridge 10 so that the cartridge may be moved during printing. As viewed in FIG. 3, the cap 60 has a bottom recess (not visible), and a top recess 62. The recess 62 receives a support (not shown) which moves the cap 60 normal to the bottom surface 48 of the cartridge body 12. Ridges 64 are provided on opposite sides of recess 62 to grip the support.

As indicated by the broken lines in FIG. 3, when the cap 60 is moved into contact with cartridge 10, side walls of cap 60 bounding its bottom recess contact the tab circuit 20 around and outside of the edges of the recess 46 in the bottom of cartridge body 12. The cap 60, tab circuit 20 and nozzle plate 16 thus define an enclosed region around and above the nozzles 37, 38 and 39 as viewed in FIG. 3.

As the cap 60 is moved into capping position, air may become trapped between the cap and cartridge 10 and forced through the nozzles of the groups of nozzles 37, 38, 39 into exit ports 40, 42 and 44. The air forms bubbles which, because of their natural buoyancy, will migrate up into the ink feed passages. These air bubbles may block the ink feed passages and cause a loss of prime. Also, if the seal between the cap 60 and cartridge 10 is tight, a vacuum may be created in the sealed region as the cap is moved away from the capping position. This vacuum may suck ink from the nozzles of the groups of nozzles 37, 38, 39 thus depleting the ink supply. Furthermore, the ink sucked from the nozzles finds its way into the region of the printer around the maintenance station where it dries on various operating components.

Figure 4:
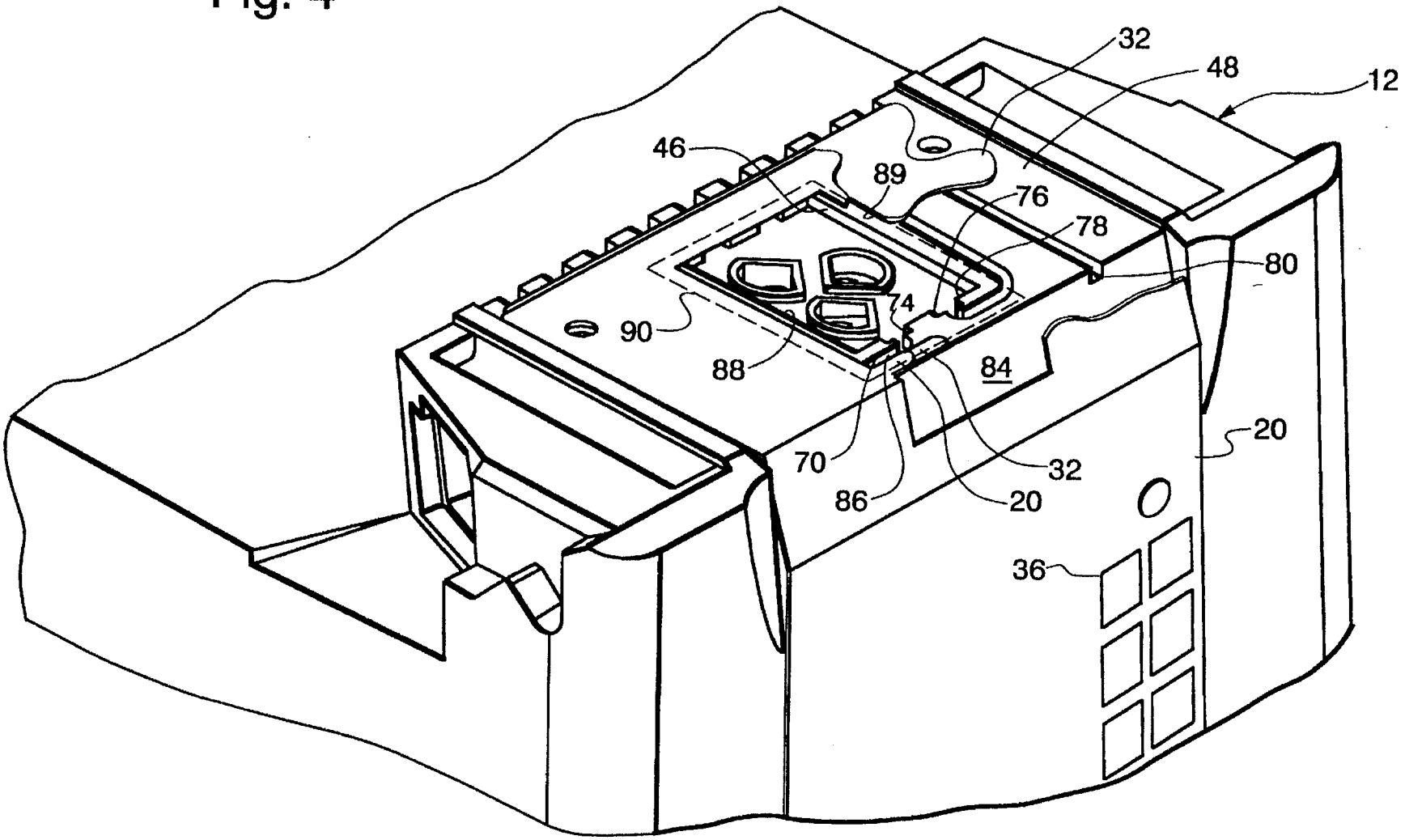

According to the present invention, these problems are solved by providing first and second vent passages 70, 72 (FIG. 2). The vent passages are preferably formed as first and second open grooves in the bottom surface 48 of the cartridge body 12 at the time the cartridge body is molded. At one end, the grooves connect with recess 46 at set-backs 74 and 76 in the side wall 78 of the recess. At the opposite end, the grooves terminate at openings 82 and 80 in a second or sloping side surface 84 of the cartridge body. As shown in FIG. 4, the open sides of the grooves are covered by the second adhesive preform 32 and tab circuit 20 so as to form the vent passages.

The openings 88 and 89 in tab circuit 20 and second adhesive preform 32 are larger than the recess 46 (see FIG. 4) so that there is a region of bottom surface 48 around side wall 78 of recess 46 and the setbacks 74 and 76 that is not covered. As shown in FIG. 4, the groove 70 extends through this region so that in addition to communicating with recess 46, a short portion 86 of groove 70 is open to the surrounding environment. Although not shown in FIG. 4 a short portion of groove 72 is likewise left uncovered.

The grooves 70 and 72 have a serpentine configuration to make them longer. This prevents air from the surrounding environment from passing through the vent passages into the region sealed between the cap 60 and cartridge 10 when the cap is in capping position.

The portions of grooves 70 and 72 which are not covered by second adhesive preform 32 or tab circuit 20 lie within the footprint of cap 60 represented by broken line 90 in FIG. 4. Therefore, when the cap is moved into capping position against the surface of tab circuit 20 the vent passages 70 and 72 are in communication with the sealed region between the cap and the cartridge. If any air is trapped in the sealed region as the cap is moved into capping position, there will be no pressure increase within the sealed region to force air into the nozzles because the trapped air may flow into the vent passages. Conversely, as the cap is moved away from the capping position vacuum in the sealed region will draw air in through the vent passages so that there will be no buildup of vacuum in the sealed region sufficient to suck ink out of the nozzles.

It should be noted that the vent passages 70 and 72 terminate at one end at openings 80 and 82 in the sloping surface 84 which is covered by the tab circuit 20. However, there is no adhesive preform on surface 84 and since the tab circuit 20 is a flexible tape-like element it will not lie completely flat against surface 84 so as to block the openings 80 and 82 of the vent passages. The vent passages may be quite small, on the order of 0.25 mm, hence only a small clearance is required between second surface 84 and tab circuit 20 in order to fully vent the passages.

From the foregoing description it is seen that the invention provides a simple venting means, carried by the cartridge, for venting the sealed region between the cartridge and a maintenance station cap. Because the venting means is associated with the cartridge, the length, width and depth of the vent paths may be selected for optimum performance depending on the physical properties of the ink in the cartridge. Thus different types of cartridges with different types of inks can be used in printers having maintenance stations where venting is not provided.

A preferred embodiment of the invention has been described in detail to illustrate the principles of the invention. It will be obvious that various modifications and substitutions may be made in the described embodiment without departing from the spirit and scope of the invention as defined by the appended claims.

We claim:

1. A cartridge for an ink-jet printer, said cartridge having a nozzle plate with nozzles therein and a contact surface which is intermittently contacted by a cap to form an air sealed region around the nozzles, said cartridge comprising:

a cartridge body having a first surface and a second surface, said first surface having a recess in which said nozzle plate is mounted, said first surface having a groove therein opening at a first end into said recess and terminating at a second end at an opening in said second surface; and, a tab circuit comprising a flexible tape-like element attached to said first surface, said tab circuit overlaying said groove to form an air vent passage extending between said recess and said second surface, said tab circuit having an opening therein so as to surround said nozzle plate.

2. A cartridge as claimed in claim 1 wherein said tab circuit is attached to said first surface by an adhesive preform, said adhesive preform and said tab circuit overlaying said groove to form said air vent passage.

3. A cartridge as claimed in claim 1 wherein said contact surface is a surface of said tab circuit.

4. A cartridge as claimed in claim 1 wherein said tab circuit overlays, but is not adhered to, said second surface of said cartridge body.

5. A cartridge as claimed in claim 1 wherein said air vent passage has a serpentine configuration.

6. A cartridge as claimed in claim 1 wherein said cartridge body has a third surface to which said tab circuit is attached.

7. A cartridge as claimed in claim 1 wherein said opening in said tab circuit is larger than said recess so that a portion of said groove near said first end is not covered by said tab circuit whereby said groove communicates directly with both said recess and ambient environment.

8. A cartridge as claimed in claim 1 wherein said recess has a side wall, said side wall having a setback, said groove opening into said recess at said setback.

9. A cartridge as claimed in claim 6 wherein said second surface is a sloping surface extending between said first surface and said third surface, said tab circuit overlaying said second surface and being spaced therefrom whereby said air vent passage vents to ambient environment between said cartridge body and said tab circuit.

10. A cartridge as claimed in claim 8 wherein said opening in said tab circuit surrounds said setback.

11. A cartridge for an ink-jet printer, said cartridge comprising:

a cartridge body having a first surface, a second surface, said first surface having a groove and a recess, said groove extending from said recess to said second surface of said cartridge body;

a tab circuit attached to said first surface by an adhesive preform, said tab circuit and said adhesive preform overlaying said groove to form an air vent passage, said tab circuit and said adhesive preform having openings therein which are larger than said recess so that said first surface has an exposed region adjacent said recess, said groove extending into said exposed region whereby a portion of said groove is open to a surrounding environment.

12. A cartridge as claimed in claim 11 wherein said groove has a serpentine configuration.

13. A cartridge as claimed in claim 11 in combination with a cap, said cartridge having a nozzle plate mounted on said first surface and said cap having a recess therein such that movement of the cap into contact with said tab circuit forms an air sealed region for said nozzle plate, said air sealed region being vented by said air vent passage.

14. A cartridge as claimed in claim 10 wherein said tab circuit comprises a flexible tape-like element, said tab circuit being attached to a third surface of said cartridge body by a further adhesive preform.

15. A cartridge as claimed in claim 14 wherein said second surface is a sloping surface extending between said first surface and said third surface, said tab circuit covering, but being slightly spaced from, said second surface whereby said air vent passage vents to the surrounding environment between said tab circuit and said cartridge body.

16. A cartridge as claimed in claim 15 and further comprising a further groove in said first surface and extending between said recess and said second surface, said tab circuit and said preform overlaying said further groove to form a further air vent passage, said further groove extending into said exposed region whereby a portion of said further groove is open to the surrounding environment.

17. A cartridge as claimed in claim 16 wherein said further groove has a serpentine configuration.

18. A cartridge as claimed in claim 16 in combination with a cap, said cartridge having a nozzle plate on said first surface and said cap having a recess therein such that movement of the cap into contact with said tab circuit forms an air sealed region for said nozzle plate, said air sealed region being vented by said air vent passage and said further air vent passage.

* * * * *